US005619829A

United States Patent [19]

Tan et al.

[11] Patent Number: 5,619,829

[45] Date of Patent: Apr. 15, 1997

[54] SOUND INSULATING WALL AND METHOD OF INSTALLING THE SAME

[75] Inventors: Tokio Tan, Tokyo; Kikuo Kazi, Saitama; Shinta Yamamura, Kanagawa; Naoyuki Furuta; Tadanori Mizukami, both of Tokyo, all of Japan

[73] Assignee: Nitto Boseki Co., Ltd, Tokyo, Japan

[21] Appl. No.: 377,940

[22] Filed: Jan. 25, 1995

[30] Foreign Application Priority Data

Jan. 26, 1994 [JP] Japan ..... 6-023526

[51] Int. Cl.[6] ..... E02D 27/00

[52] U.S. Cl. ..... 52/293.3; 52/295; 404/9

[58] Field of Search ..... 52/293.1, 293.3, 52/294, 295, 169.4, 169.1, 264, 781.5; 256/73, 19, 13.1; 405/286; 404/9, 12, 13

[56] References Cited

U.S. PATENT DOCUMENTS

| | | | |
|---|---|---|---|
| 3,233,376 | 2/1966 | Naillon et al. | 52/264 |
| 3,372,519 | 3/1968 | Russell | 52/293.1 X |
| 3,623,288 | 11/1971 | Horowitz | 52/293.3 X |
| 3,755,982 | 9/1973 | Schmidt | 52/264 X |
| 3,852,931 | 12/1974 | Morse et al. | 52/293.3 |
| 3,898,779 | 8/1975 | Tracy | 52/264 |
| 4,899,498 | 2/1990 | Grieb . | |
| 5,015,119 | 5/1991 | Schmanski . | |
| 5,022,781 | 6/1991 | Smith . | |
| 5,149,061 | 9/1992 | Borgnini | 404/12 X |
| 5,244,172 | 9/1993 | Allega . | |
| 5,404,685 | 4/1995 | Collins | 256/19 X |

FOREIGN PATENT DOCUMENTS

| | | |
|---|---|---|
| 2560243 | 8/1985 | France . |
| 3152582 | 12/1993 | Germany . |

*Primary Examiner*—Lanna Mai

*Attorney, Agent, or Firm*—Sixbey, Friedman, Leedom & Ferguson, P.C.; Gerald J. Ferguson, Jr.; David S. Safran

[57] ABSTRACT

Fixing members are mounted, at predetermined intervals, on the top portion of a footing that is built along a road. A concrete-type board having vertical through-holes is mounted on the footing through the fixing member. Steel rods each having top and bottom threaded portions are inserted into the respective through-holes of the board with the bottom threaded portions being threadedly engaged with the respective fixing members. Upper nuts are engaged with the top threaded portions of the respective rods, to thereby fix the board onto the footing.

6 Claims, 6 Drawing Sheets

X-X

FIG. 2A
FIG. 2B
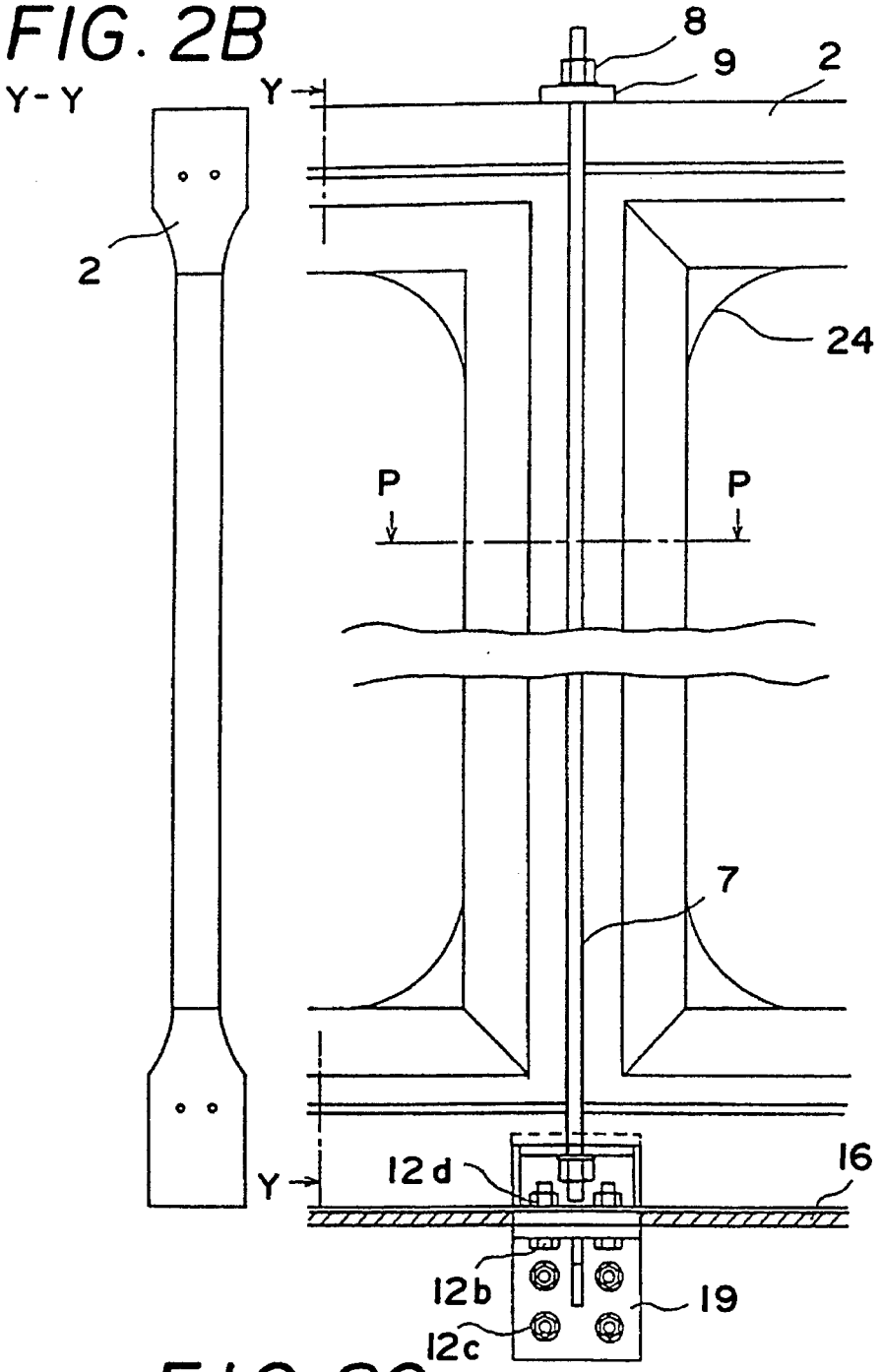
FIG. 2C
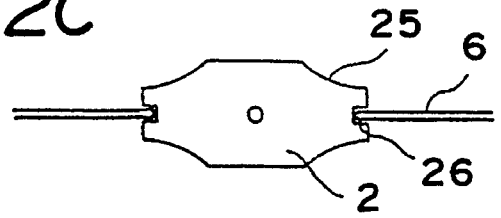

FIG. 3A
FIG. 3B
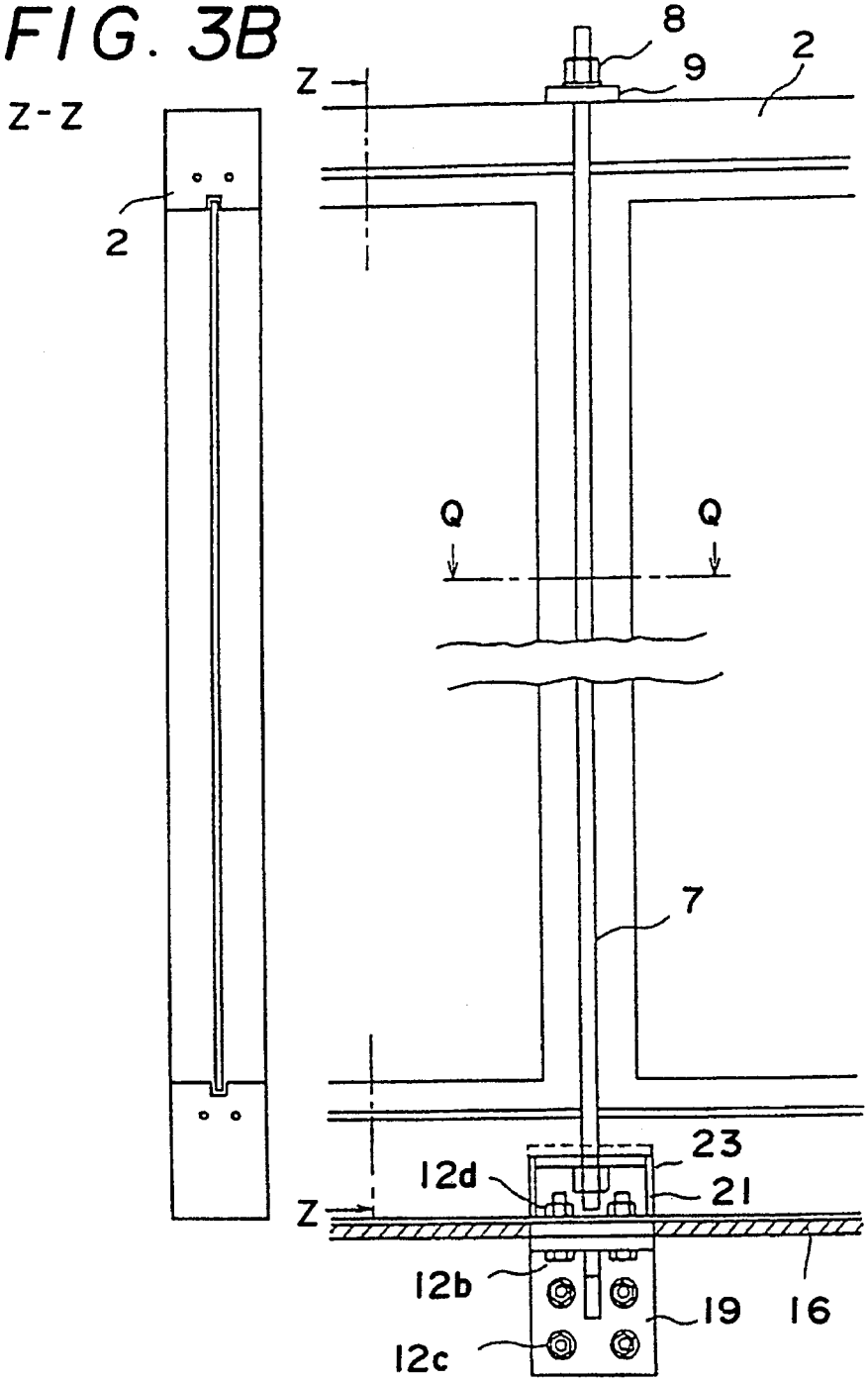
FIG. 3C
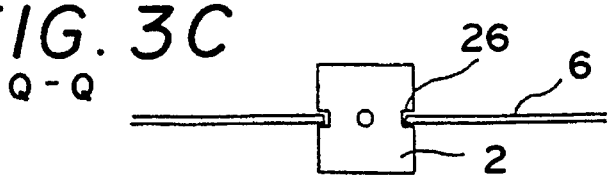

FIG. 4B
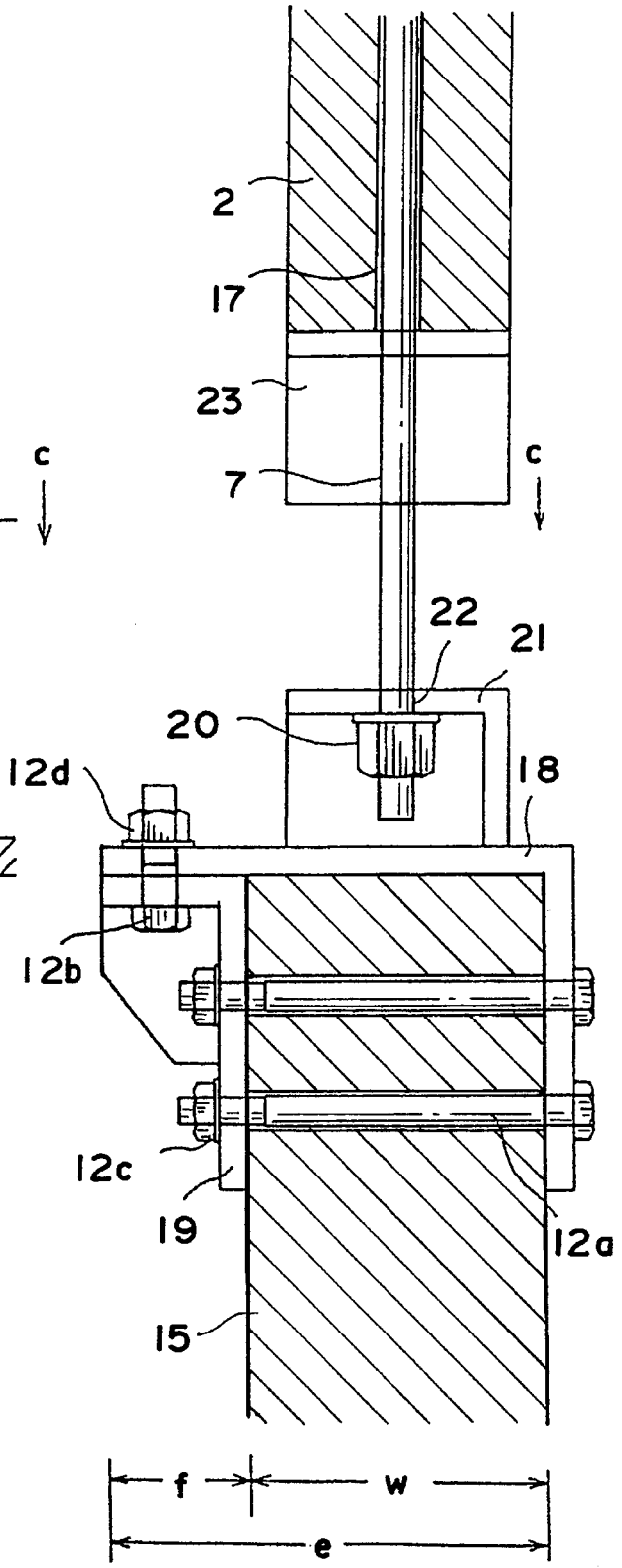
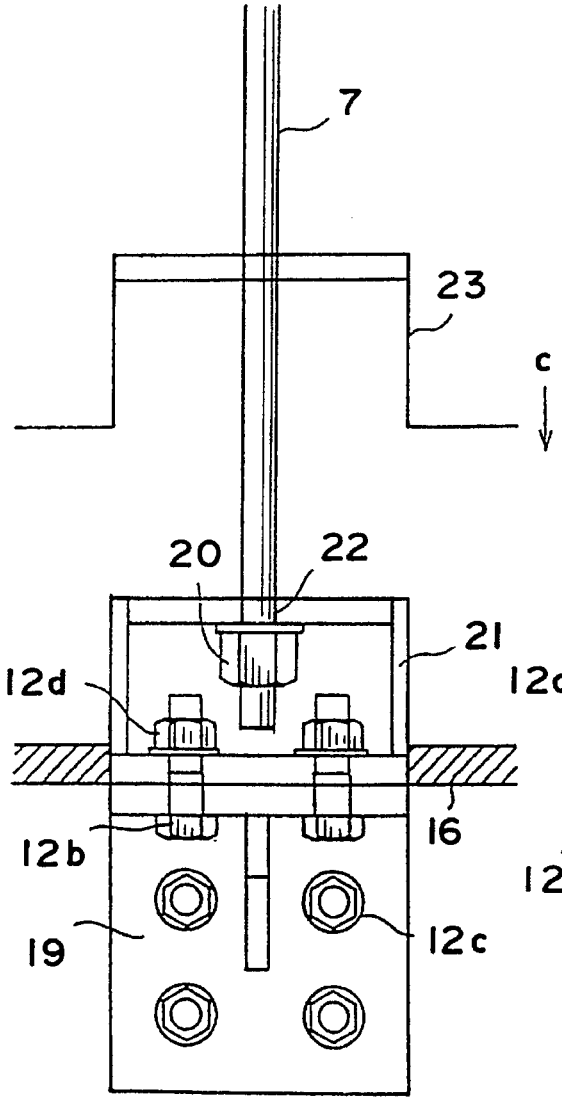
FIG. 4A

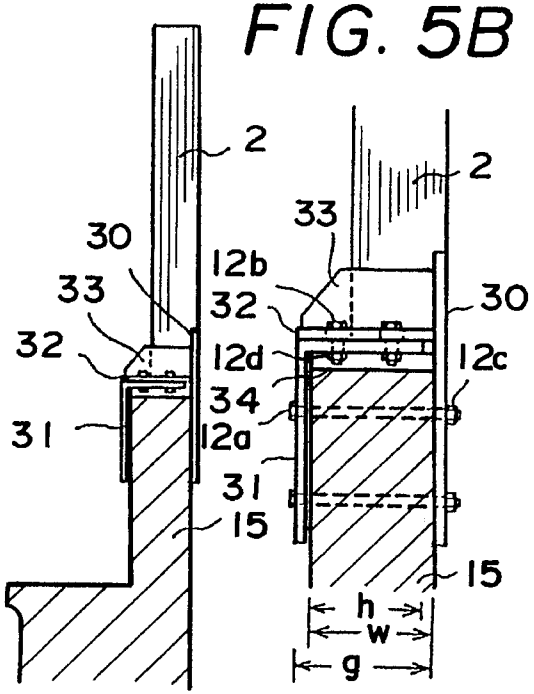
FIG. 5B
FIG. 5A
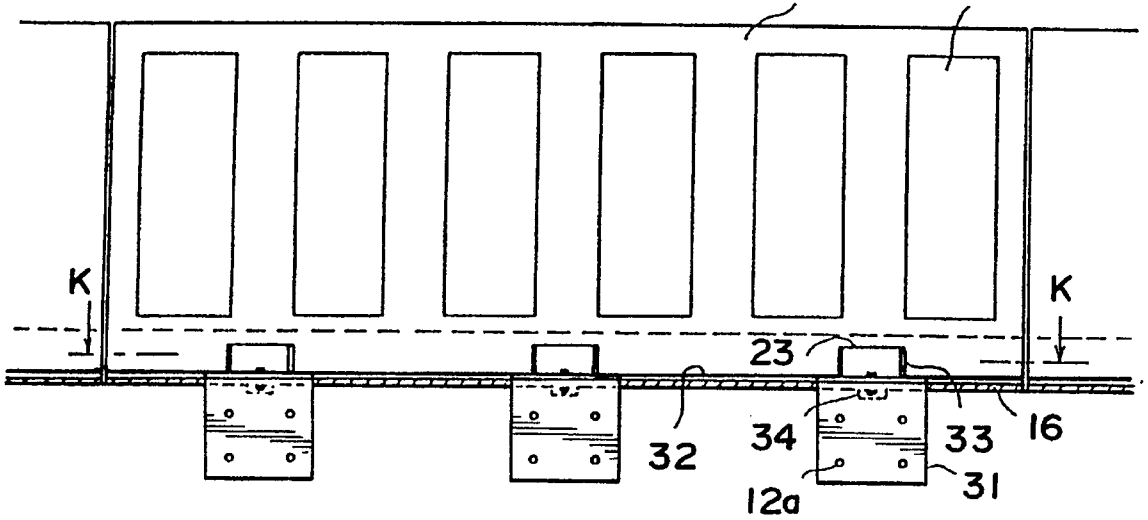
FIG. 5C
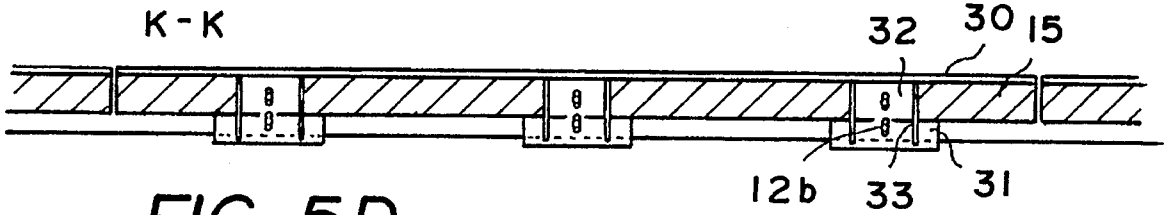
FIG. 5D

SOUND INSULATING WALL AND METHOD OF INSTALLING THE SAME

BACKGROUND OF THE INVENTION

This invention relates to improvements of a sound insulating wall which is erected along a road such as an expressway where a lot of noise is produced, and of a method of installing the sound insulating wall.

Conventionally, a sound insulating wall is constructed as follows: H-section steel bars are vertically placed at certain intervals (usually 2 to 4 m) on a footing, such as a railing, erected along an expressway or the like with their flanges faced with each other, and concrete boards (usually 2 m in width and 0.5 m in height) or unit boards (usually 4 m in width and 1 m in height) formed by combining a metal frame with a sound absorbing material or a plastic plate are set between the erected H-section steel bars by sliding them down through their flanges.

Hence, in an installation site of the sound insulating wall, it takes much labor to erect a number of H-section steel bars and to sliding down the unit boards or concrete boards through the flanges of the H-section steel bars. The sound insulating wall thus constructed is not smooth nor continuous in external appearance because the H-section steel bars appear at intervals of 2 to 4 m, and is very monotonous and drab. That is, unavoidably the sound insulating wall does not match the concrete road. On the other hand, the unit boards may be made dirty by wind, rain or dust. In order to clean those unit boards, it is necessary to disengage them from the H-section steel bars, and engage them again with the latter after being cleaned. This work not only takes much labor but is also hazardous to workers.

SUMMARY OF THE INVENTION

In view of the foregoing, an object of the invention is to provide a sound insulating wall which is free from such heavy work as erecting a number of H-section steel bars at an installation site, sliding down the unit boards or concrete boards through the flanges of the erected H-section steel bars, and cleaning dirt, to thereby greatly save labor in construction and maintenance, which assures excellent continuity and a long span by virtue of elimination of a number of H-section steel bars, and which can provide a varied appearance after the construction, to thereby well match a concrete road or railing and become excellent in design, and also to provide a method of installing such a sound insulating wall.

Another object of the invention is to provide a sound insulating wall having transparent plates which can greatly save labor of cleaning when the transparent plates are made dirty by wind, rain or dust, and which can provide a varied appearance after the construction by varying the shape of the transparent plates, and also to provide a method of installing such a sound insulating wall.

According to the invention, a sound insulating wall comprises:

fixing members mounted, at predetermined intervals, on a top portion of a footing that is built along a road;

a concrete-type board mounted on the footing through the fixing member, the board having through-holes vertically formed therein at the predetermined intervals;

steel rods each having top and bottom threaded portions and inserted into the respective through-holes of the board, the bottom threaded portions being threadedly engaged with the respective fixing members; and upper nuts being threadedly engaged with the top threaded portions of the respective rods, to thereby fix the board onto the footing.

According to another aspect of the invention, a sound insulating wall comprises:

a concrete-type board mounted on a footing that is built along a road, the board having cuts formed in a bottom portion at predetermined intervals;

a vertical fixing plate extending vertically from an outer surface of a lower end portion of the board, and covering the cuts;

a horizontal fixing plate attached to a bottom surface of the board and fixed to the vertical fixing plate, the vertical and horizontal fixing plates being integral with the board;

fixing members each comprising a horizontal plate and a vertical plate, the vertical plate being fastened to the vertical fixing plate with bolts and nuts through a top portion of the footing;

at least one fixing metal fitting nut fixed to a bottom surface of the horizontal plate of each of the fixing members and accommodated in corresponding one of grooves formed in a top surface of the footing; and at least one fixing metal fitting bolt threadedly engaged with the fixing metal fitting nut, to thereby fasten the horizontal fixing plate to the horizontal plate of the fixing member.

Further, according to the invention, a method of installing a sound insulating wall comprises the steps of:

lifting a concrete-type board having through-holes vertically formed therein at predetermined intervals, and setting it upright with a crane on a footing that is built along a road;

inserting steel rods each having top and bottom threaded portions into the respective through-holes of the board;

threadedly engaging the bottom threaded portions of the rods with respective fixing members that are in advance fixed to a top portion of the footing at the predetermined intervals; and threadedly engaging upper nuts with the top threaded portions of the respective rods, to thereby fix the board onto the footing.

According to another aspect of the invention, a method of installing a sound insulating wall comprises the steps of:

preparing a concrete-type board having cuts in a bottom portion at predetermined intervals and being integral with a vertical fixing plate covering the cuts and a horizontal fixing plate extending horizontally and fixed to the vertical fixing plate;

arranging fixing members each comprising a horizontal plate and a vertical plate on a top portion of a footing that is built along a road, the horizontal plate having at least one fixing metal fitting nut fixed to a bottom surface thereof and accommodated in corresponding one of grooves formed in a top surface of the footing at the predetermined intervals;

lifting the board with a crane, and setting it upright on the footing such that the horizontal fixing plate face the horizontal plates of the fixing members; and threadedly engaging a bottom threaded portion of at least one fixing metal fitting bolt with the fixing metal fitting nut that is fixed to each of the horizontal plates of the fixing members, and fastening the vertical plates of the fixing members through the top portion of the footing to the vertical fixing plate with bolts and nuts, to thereby fix the board onto the footing.

BRIEF DESCRIPTION OF THE DRAWINGS

FIG. 2A is front view showing part of a sound insulating wall according to a second embodiment of the invention;

FIGS. 2B and 2C are sectional views taken along lines Y—Y and P—P in FIG. 2A, respectively.

FIG. 3A is front view showing part of a sound insulating wall according to a third embodiment of the invention;

FIGS. 3B and 3C are sectional views taken along lines Z—Z and Q—Q in FIG. 3A, respectively.

FIGS. 4A and 4B are a front view and a side view, respectively, showing a lower portion of the sound insulating walls of the second and third embodiments;

FIGS. 5A–5C are a side view, an enlarged partial side view and a front view, respectively, of a sound insulating wall according to a fourth embodiment of the invention;

FIG. 5D is a sectional view taken along line K—K in FIG. 5C; and

DESCRIPTION OF THE PREFERRED EMBODIMENTS

Figures 1A, 1B, 1C, 1D:
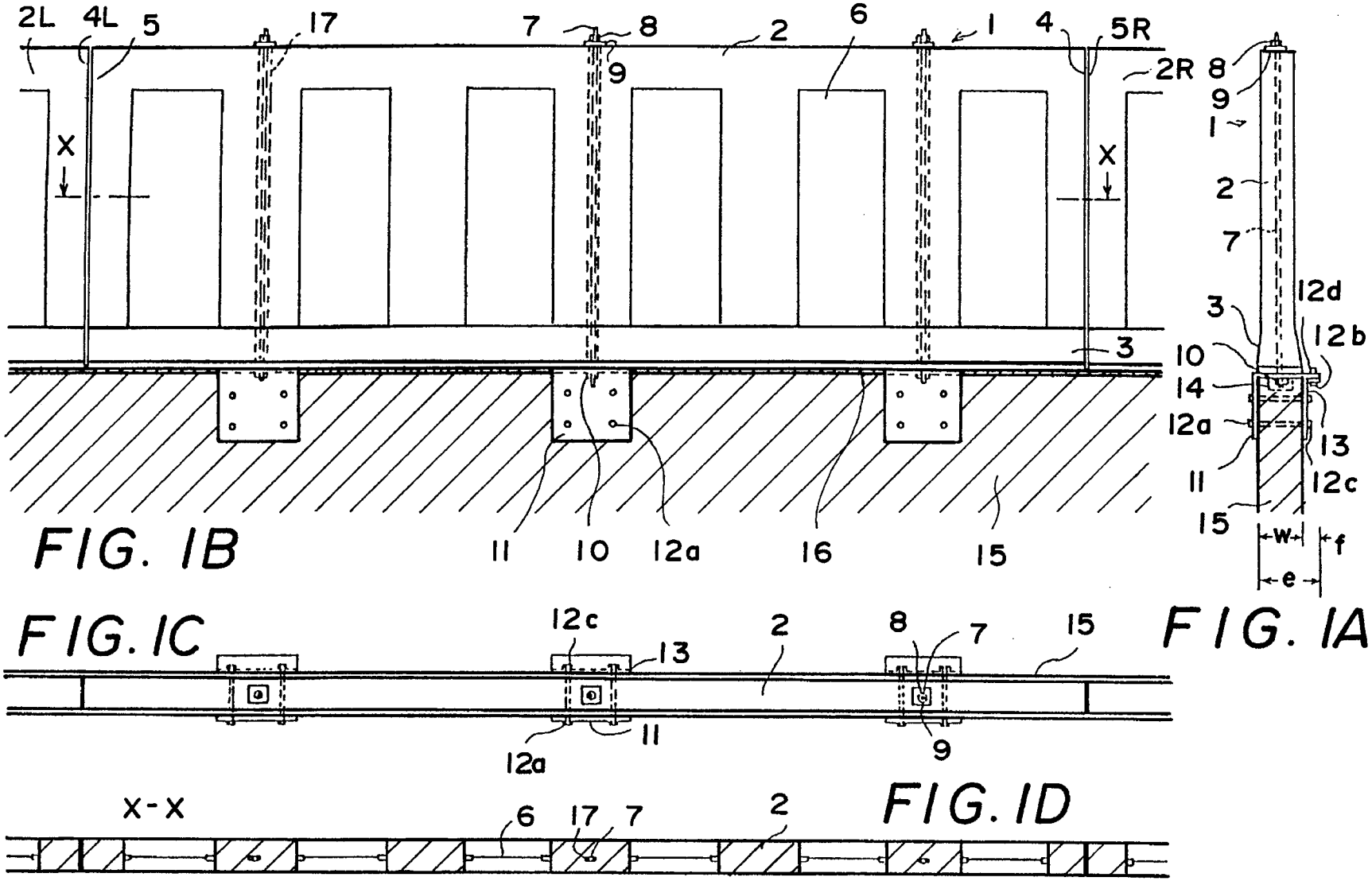
FIGS. 1A–1C are side, front and plan views, respectively, of a sound insulating wall according to a first embodiment of the invention.
FIG. 1D is a sectional view of the sound insulating wall according to the first embodiment of the invention.

Preferred embodiments of the invention will be described with reference to the accompanying drawings.

In a first embodiment shown in FIGS. 1A–1D, a rectangular concrete-type board 2 is erected on a concrete footing, namely, a railing 15 which is built along an expressway or the like. To increase the rigidity of the board 2, their base portion is made thicker than the upper portion. In this embodiment, the board 2 is made of a PC-steel-reinforced precast and prestressed concrete. However, in the invention, the material of the concrete-type board 2 is not particularly limited; that is, it may be a concrete reinforced by alkali-resistant glass fiber, carbon fiber, vinylon fiber. Among the above materials, the PC-steel-reinforced precast and prestressed concrete is most suitable to increase the span of the sound insulating wall, because it can provide thinner and lighter concrete-type boards. In addition, even if a vehicle collides with the PC-steel-reinforced precast and prestressed concrete board, there never occurs such an event that fragments of the board scatter. Furthermore, the PC-steel-reinforced precast and prestressed concrete board is advantageous in wind resistance, earthquake resistance, and durability.

The board 2 is of a rectangle with its longer side extending horizontally. In this embodiment, the concrete board 2 is 4.5 m in horizontal length (longer than the span of conventional sound insulating walls which is usually 2 to 4 m), and 1.5 m in height and 15 cm in thickness. In practice, the span, height and thickness should be determined according to a specification required for each insulating wall. When necessary, rectangular windows are formed in the board 2 with their longer side extending vertically, and transparent plates 6 of polycarbonate are detachably fitted in the rectangular windows thus formed. The material of the transparent plates 6 is selected from glass, plastics such as polycarbonate and acryl and combinations thereof in view of the sound insulation, weatherproof performance and design. The transparent plates 6 may have shapes other than a rectangle. For example, they may have shapes shown in FIGS. 6A–6C. The method of fitting the transparent plate 6 in the window of the board 2 is not particularly limited. For example, in the embodiments of FIGS. 2A–2C and 3A–3C, the transparent plate 6 is fitted in a groove that is formed in a frame of the window. If a metal fitting or the like for fixing of a sign indicating, for instance, road maintenance work is attached to the concrete board 2 in advance, it will contribute to a reduction in period of the road maintenance work. This is a secondary effect of the invention.

The concrete board 2 has three through-holes 17 which penetrate the concrete board 2 vertically, at the center in the horizontal, i.e., longitudinal direction and at positions symmetrically spaced from the center by 1.5 m. Steel rods 7 each having threaded portions at both ends are inserted in the respective through-holes 17. To smoothly insert the rods 7 into the through-holes 17, and for convenience in adjusting their fixing positions on the top surface of the railing 15 for a variation in dimensions of the board 2, it is desirable that the through-holes 17 be formed such that in molding the board 2, pipes elliptical in section are buried therein so that the major axes of those pipes extend in the longitudinal direction of the board 2, to thereby form an integral part.

Fixing members are fixed to the top surface of the railing 15 at the same intervals as the through-holes 17 of the board 2. Each of the fixing members consists of an upper fixing metal fitting 11 and a lower fixing metal fitting 13 each shaped like an inverted L and having a horizontal plate. The length e of the lower surface of the horizontal plate of the upper fixing metal fitting 11 is larger than the width w of the top surface of the railing 15, and the length f of the upper surface of the horizontal plate of the lower fixing metal fitting 13 is set at e–w.

In the following description, unless otherwise specified, the side or surface of a component on the road side will be referred to as an "inner side or surface" when applicable, and that of a component on the opposite side will be referred to as an "outer side or surface" when applicable.

Above the top surface of the railing 15, each of the through-holes 17 is set approximately at the center of the horizontal plate of the upper fixing metal fitting 11. The upper fixing metal fitting 11 is placed on the top portion of the railing 15 so that the outer surface of the vertical plate of the upper fixing metal fitting 11 is brought into contact with the inner surface of the top portion of the railing 15. The top surface of the horizontal plate of the lower fixing metal fitting 13 is brought into contact with the bottom surface of the horizontal plate of the upper fixing metal fitting 11 so that the ends of both horizontal plates become flush with each other. The inner surface of the vertical plate of the lower fixing metal fitting 13 is brought into contact with the outer surface of the top portion of the railing 15. Under these conditions, the vertical plates of the upper and lower fixing metal fittings 11 and 13 are fastened to each other with four metal-fitting fixing bolts **12*a* and four metal-fitting fixing nuts 12*c*, and the end portions of the horizontal plates of the upper and lower fixing metal fittings 11 and 13 are fastened to each other with two metal-fitting fixing bolts 12*b* and two metal-fitting fixing nuts 12*d***.

The horizontal and vertical plates of the upper fixing metal fitting 11 and those of the lower fixing metal fitting 13 are formed, in advance, with (round) holes into which the aforementioned bolts are to be inserted. It is desirable that the holes in the horizontal plate of the lower fixing metal fitting 13 be elliptical holes whose major axes extend in the thickness direction of the railing 15, to accommodate a variation in the thickness of the railing 15.

A lower nut 10, which is to be engaged with the bottom threaded portion of the rod 7, is fixedly secured to the bottom surface of the horizontal plate of the upper fixing metal fitting 11 substantially at its center so as to correspond to the through-hole 17. The top surface of the railing 15 is formed with a groove 14 that is slightly larger than the lower nut 10 so that the horizontal plate of the upper fixing metal fitting 11 can be placed on the top surface of the railing 15 with no inclination.

The board 2 is installed on the railing 15 in the following manner. Rubber sealing materials 16 are laid on the top surface of the railing 15 except where the horizontal plates of the upper fixing metal fittings 11 are located, and the concrete board 2 is set on the sealing materials 16 thus laid. Under this condition, the bottom threaded portions of the rods 7 inserted into the three through-holes 17 are engaged with the lower nuts 10, and upper nuts 8 are engaged through upper washers 9 with the top threaded portions of the rods 7, to thereby fasten the board 2 onto the top surface of the railing 15. Instead of rubber, foamed plastics may be used as the sealing material. To assure sufficient waterproof performance, it is preferred that the gaps between the rods 7 and the through-holes 17 be filled with grout.

Other boards 2L and 2R, which are equal to the above-described board 2, are set on both sides of the board 2. More specifically, as viewed from the road side, the right end face 4L of the left board 2L is brought into contact with the left end face 5 of the board 2, and the left end face 5R of the right board 2R is brought into contact with the right end face 4 of the board 2. Under this condition, the boards 2L and 2R are fastened onto the top surface of the railing 15 in the same way as the concrete board 2 is done. Thus, a continuous sound insulating wall having a desired horizontal length is completed.

FIGS. 2A–2C, 3A–3C and 4A–4B show other embodiments which use fixing members different in structure from those in the embodiment of FIGS. 1A–1D.

The fixing member consists of an upper fixing metal fitting 18 and a lower fixing metal fitting 19 each shaped like an inverted L and having a horizontal plate, and a box-shaped protrusion 21 which is fixedly mounted on the top surface of the horizontal plate of the upper fixing metal fitting 18 and is opened toward the road (toward the viewer in FIG. 4A and toward the left in FIG. 4B). The length e of the bottom surface of the horizontal plate of the upper fixing metal fitting 18 is larger than the width w of the top surface of the railing 15. The length f of the top surface of the lower fixing metal fitting 19 is set at e–w. In these embodiments, the box-shaped protrusion 21 is opened toward the road; however, it may be opened toward the opposite side.

Above the top surface of the railing 15, the central axis of each of the through-holes 17 is set at the position of the top surface of the horizontal plate of the upper fixing metal fitting 18 which position is approximately at the center of the top surface width w of the railing 15. The upper fixing metal fitting 18 is placed on the top portion of the railing 15 so that the inner surface of the vertical plate of the upper fixing metal fitting 18 is brought into contact with the outer surface of the top portion of the railing 15. The top surface of the horizontal plate of the lower fixing metal fitting 19 is brought into contact with the bottom surface of the horizontal plate of the upper fixing metal fitting 18. The outer surface of the vertical plate of the lower fixing metal fitting 19 is brought into contact with the inner surface of the top portion of the railing 15. Under these conditions, the vertical plates of the upper and lower fixing metal fittings 18 and 19 are fastened to each other with washers four metal-fitting fixing bolts **12*a* and four metal-fitting fixing nuts 12*c*, and the end portions of the horizontal plates of the upper and lower fixing metal fittings 18 and 19 are fastened through washers to each other with two metal-fitting fixing bolts 12*b* and two metal-fitting fixing nuts 12*d***.

Holes are formed in the horizontal and vertical plates of the upper and lower fixing metal fittings 18 and 19 in the same manner as described in connection with FIG. 1.

The aforementioned box-shaped protrusion 21 is fixedly secured to the top surface of the horizontal plate of the upper fixing metal fitting 18, and its top plate has an insertion hole 22 into which the rod 7 is inserted. On the other hand, the board 2 has cuts 23 in lower end portions which cuts are equal in size to the box-shaped protrusions 21. The box-shaped protrusions 21 are tightly fitted into the cuts 23, and the rods 7 are inserted into the through-holes 17 and the insertion holes 22 formed in the top plates of the box-shaped protrusions 21. Under this condition, lower nuts 20 are engaged with the bottom threaded portions of the rods 7 through washers. (FIGS. 4A and 4B show a state in which the box-shaped protrusion 21 is being inserted into the cut 23. That is, the board 2 is moved in the direction of arrow c to fit into the cuts 23 of the box-shaped protrusion 21.)

The space in each of the box-shaped protrusions 21 can be utilized to adjust the fixing metal fitting nuts **12*d* and the lower nut 20. Since the box-shaped protrusions 21 are tightly fitted in the cuts 23, the cuts 23 never adversely affect the insulation of noises from the road. From the viewpoints of waterproofness and external appearance, it is preferred that the spaces of the box-shaped protrusions 21** be filled with grout.

In the same manner as in the sound insulating wall of the embodiment of FIGS. 1A–1D, the sealing materials 16 are laid over the railing 15 before the board 2 is mounted on the railing 15, and the board 2 is fixed onto the top surface of the railing 15 by engaging the upper nuts 8 through the upper washers 9 with the top threaded portions of the rods 7.

In the embodiment of FIGS. 2A–2C, transparent plates 6 each rounded at the four corners are fitted in grooves 26 of the frames of windows formed in the board 2, and the flange portions of the board 2 around the windows are shaped like a picture frame, to thereby enhance the design performance. In the embodiment of FIGS. 3A–3C, transparent plates 6 having a simple rectangular shape are fitted in grooves 26 of the frames of windows formed in the board 2.

FIGS. 5A–5D show a fourth embodiment of the invention which is different from the above-described embodiments in that it does not use through-holes nor rods.

In this embodiment, a board 2 is so molded as to be integral with a vertical fixing plate 30, a horizontal fixing plate 32 and three pairs of reinforcing ribs 33. The board 2 has three cuts 23 in lower end portions at predetermined intervals, i.e., at the center of the longitudinal length of the board and positions symmetrically spaced by 1 m from the center. The vertical fixing plate 30 extends vertically from the lower end portion of the outer surface of the board 2 and extends horizontally over the whole span of the board 2, and its outer surface is flush with the outer surface of the board 2. The horizontal fixing plate 32, which is located beneath the bottom surface of the board 2, has a width g slightly larger than a width w of the top surface of the railing 15, and extends horizontally over the whole span of the board 2 with its end secured to the vertical fixing plate 30. The two reinforcing ribs 33, which are attached to the right and left vertical walls of the cuts 23 of the board 2, extend upward from the horizontal fixing plate 32. The cuts 23 are covered by the vertical fixing plate 30.

In this embodiment, a fixing member is made up of an inverted-L-shaped inner fixing metal fitting 31, the vertical fixing plate 30 and the horizontal fixing plate 32. The inner fixing metal fitting 31 is mounted on the railing 15 so as to be aligned with the center of the corresponding cut 23 and so that the top surface of the horizontal plate comes in contact with the bottom surface of the horizontal fixing plate 32 while the outer surface of the vertical plate comes in contact with the inner surface of the top portion of the railing 15. Under this condition, the vertical plate of the inner fixing metal fitting 31 is fastened to the vertical fixing plate 30 with four fixing metal fitting bolts 12*a* and four fixing metal fitting nuts 12*c* through washers. The horizontal plate of the inner fixing metal fitting 31 is fastened to the horizontal fixing plate 32 by engaging the bottom threaded portions of two fixing metal fitting bolts 12*b* with respective fixing metal fitting nuts 12*d*, which have been fixedly secured to the bottom surface of the horizontal plate of the inner fixing metal plate 31. A length h of the bottom surface of the horizontal plate of the inner fixing metal fitting 31 is slightly smaller than the width w of the top surface of the railing 15. The protrusion length g of the horizontal fixing plate 32 is made slightly larger than the width w of the top surface of the railing 15, to accommodate a variation in the top surface width w of the railing 15.

The top surface of the railing 15 is formed with grooves 34 that are slightly wider than the fixing metal fitting nuts 12*d* so that the horizontal plates of the inner fixing metal fittings 31 are placed parallel with the top surface of the railing 15.

The horizontal and vertical plates of the inner fixing metal fitting 31 and the vertical fixing plate 30 and the horizontal fixing plate 32 are formed, in advance, with (round) holes into which the aforementioned bolts are to be inserted. It is desirable that the holes in the horizontal fixing plate 32 be elliptical holes whose major axes extend in the thickness direction of the railing 15, to accommodate a variation in the top surface width w of the railing 15.

The board 2 is installed on the railing 15 in the following manner. Sealing materials 16 is laid on the top surface of the railing 15 except where the horizontal plates of the inner fixing metal fittings 31 are located, and the board 2 is set on the sealing materials 16 thus laid. Under this condition, the bottom threaded portions of the two fixing metal fitting bolts 12*b* being inserted are engaged with the respective fixing metal fitting nuts 12*d*, and the vertical plate of the inner fixing metal fitting 31 is fastened through the railing 15 to the vertical fixing plate 30 with the four bolts, nuts and washers.

The space of the cut 23 facilitates the adjustment of the bolts 12*b*. Since the cuts 23 are covered by the vertical fixing plate 30, the cuts 23 never adversely affect the insulation of noises from the road.

In each of the above embodiments, the transparent plates 6 are employed. However, in the invention, whether to use the transparent plates 6 is determined according to the purpose of the sound insulating wall. Instead of the transparent plates 6, composite sound absorbing/insulating plates containing a sound absorbing material or a decorating material may be employed. Alternatively, the windows may be eliminated from the sound insulating wall.

In each of the above embodiments, the railing 15 is employed as the footing. Instead of the railing 15, a bank structure may be employed.

Figure 6A:
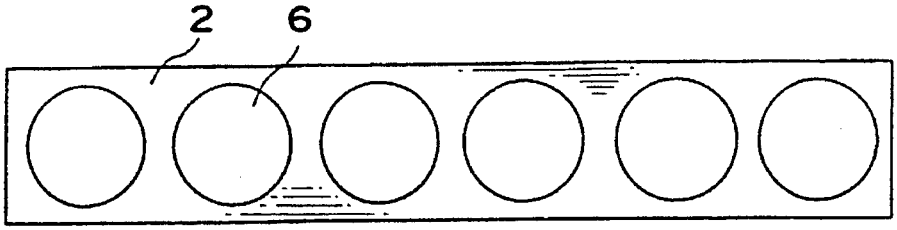
FIGS. 6A–6C are front views showing three shapes of transparent plates which may be employed in the sound insulating wall of the invention.
Figure 6B:
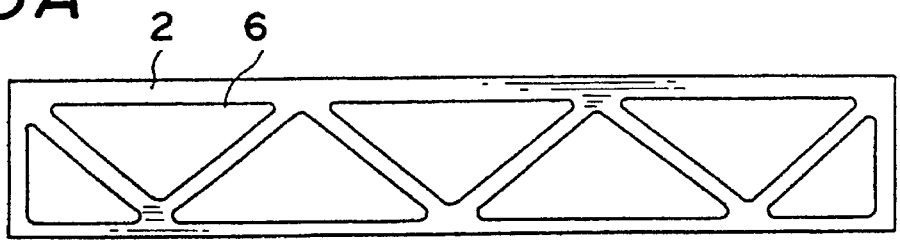
Figure 6C:
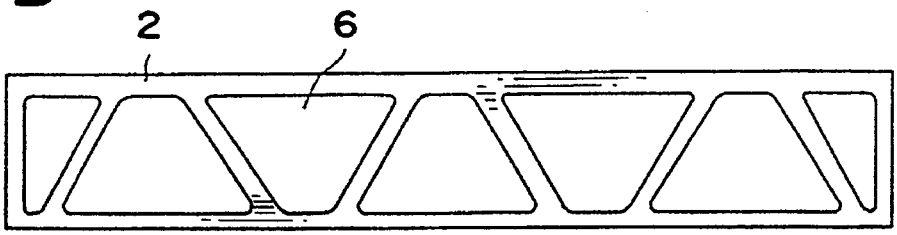

FIGS. 6A–6C show various shapes of transparent plates 6 other than the shapes employed in the above embodiments. The transparent plates shown in FIGS. 6A–6C are circular, triangular and trapezoidal, respectively. For example, windows may be formed in the board 2 so as to incorporate transparent plates having the shapes of FIGS. 6A–6C in combination, in which case superior design performance is expected.

In the above embodiments, the board 2 is described as being rectangular. However, the board 2 may be changed freely in configuration if it is made of PC-steel-reinforced precast and prestressed concrete. For instance, it is possible to form a board which is rhombic, has an arch-shaped or wave-shaped decoration on its top, or has decorations on its vertical surface. That is, the use of the PC-steel-reinforced precast and prestressed concrete allows selection from a variety of shapes, and is therefore advantageous in terms of design.

Now, a description will be made of a method of installing the sound insulating wall shown in FIGS. 1A–1D.

The rectangular concrete-type board 2 has the transparent plates 6 detachably fitted in the windows formed therein, and the vertical through-holes 17 arranged at predetermined intervals. The horizontal plates of the upper fixing metal fittings 11 and the sealing materials 16 are laid on the top surface of the railing 15, which is built along the road. First, a crane is used to lift the concrete board 2 to which wires are applied, and then set it upright on the railing 15 through the horizontal plates of the upper fixing metal fittings 11 and the sealing materials 16. Thereafter, the rods 7 having the threaded portions at both ends are inserted into the vertical through-holes 17, and the bottom threaded portions of the inserted rods 7 are engaged with the lower nuts 10 which have been fixedly secured to the bottom surfaces of the horizontal plates of the upper fixing metal fittings 11 and accommodated in the grooves 14 formed in the top portion of the railing 14. Then, the upper nuts 8 are engaged with the top threaded portions of the rods 7 through the washers 9. Thus, the board 2 is fixedly erected on the railing 15.

It is preferable that the through-holes 17 be formed such that in molding the board 2, pipes elliptical in cross section are buried in the board 2 so that their major axes extend in the longitudinal direction of the board 2, to thereby produce an integral part. With the concrete board thus formed, the rods 7 can be smoothly inserted into the through-holes 17, namely, the pipes. In addition, even if the board 2 is somewhat deviated in dimension, its position on the railing 15 can be adjusted conveniently.

Next, a description will be made of a method of installing the sound insulating walls shown in FIGS. 2A–2C, 3A–3C and 4A–4B.

A crane is used to lift the board 2 to which wires are applied, and then set it upright on the railing 15 through the horizontal plates of the upper fixing metal fittings 18 and the sealing materials 16 both of which have been laid over the top surface of the railing 15, which is built along the road. Thereafter, the cuts 23, which are formed in the bottom portion of the board 2 at the predetermined intervals, are fitted into the respective box-shaped protrusions 21 provided on the top surfaces of the horizontal plates of the upper fixing metal fittings 18. Under this condition, the lower nuts 20 are engaged through the washers with the bottom threaded portions of the rods 7 which have been inserted into the through-holes 17 and into the insertion holes 22 formed in the horizontal top plates of the box-shaped protrusions 21, and the upper nuts 8 are engaged through the washers 9 with the top threaded portions of the rods 7. Thus, the board 2 is fixedly erected on the railing 15.

A description will be made of a method of installing the sound insulating wall shown in FIGS. 5A–5D.

A crane is used to lift the concrete board 2 to which wires are applied, and then set it upright on the railing 15 through the horizontal plates of the inner fixing metal fittings 31 and the sealing materials 16 both of which have been laid over the top surface of the railing 15, which is built along the road. Under this condition, the two fixing metal fitting bolts 12 are inserted into the horizontal plate of each inner fixing metal fitting 31 and the horizontal fixing plate 32, and the bottom threaded portions of the bolts 12 are engaged with the fixing metal fitting nuts 12*d*, to fasten the horizontal plate of the inner fixing metal fitting 31 to the horizontal fixing plate 32. Then, the vertical plate of the inner fixing metal fitting 31 is fastened through the railing 15 to the vertical fixing plate 30 with the four fixing metal fitting bolts 12*a* and nuts 12*c* and the washers. Thus, the board 2 is erected on the railing 15.

According to the sound insulating wall and the installation method of the invention, there is not needed such heavy work as erecting a number of H-section steel bars at an installation site, and sliding down unit boards or concrete boards through the flanges of the erected H-section steel bars, resulting in great saving of labor in construction and maintenance. The elimination of a number of H-section steel bars assures excellent continuity and a long span of the sound insulating wall.

Since a varied appearance is obtained after the construction, the wall well matches a concrete road or footing and is excellent in design.

The concrete-type board can be erected on a footing with high efficiency by using the rods and the simple fixing members, or by using the vertical and horizontal fixing plates integral with the board in combination with the fixing members.

Where the transparent plates used, the invention can greatly save labor of cleaning required when they are made dirty by wind, rain or dust, because they can be removed for the cleaning. The invention can provide a varied appearance after the construction by varying the shape of the transparent plates.

Where the board is made of PC-steel-reinforced precast and prestressed concrete, it can be made thinner and lighter, thus becoming suitable for provision of a board having a long span. Further, even when a vehicle crashes against such a board, there will not occur an event that fragments of the board scatter. Furthermore, such a board is advantageous in wind resistance, earthquake resistance and durability. In addition, the board is advantageous in terms of design, because the shape of the board can be selected from a variety of choices.

What is claimed is:

1. A sound insulating wall comprising:

fixing members mounted, at predetermined intervals, on a top portion of a footing that is built along a road;

a concrete-type board mounted on the footing by the fixing member, the board having through-holes vertically formed therein at the predetermined intervals;

steel rods, each having top and bottom threaded portions and being inserted into the respective through-holes of the board, the bottom threaded portions being threadedly engaged with the respective fixing members; and upper nuts being threadedly engaged with the top threaded portions of the respective rods, to thereby fix the board onto the footing;

wherein each of the fixing members compries a pair fitting plates clamped to a top end portion of the footing; wherein each said fixing member has a top wall with a hole therethrough; wherein a recess is formed below the top wall of said fixing member and above a top surface of said footing; and wherein a threaded member is fixed to an underside of said top wall within said recess and in alignment with said hole, the bottom threaded portion of a respective one of said steel rods being threadedly engaged in said threaded member.

2. A sound insulating wall as claimed in claim 1, wherein each of the fixing members further comprise a horizontal plate; wherein said recess is in a box-shaped protrusion which is fixed to a top surface of the horizontal plate and is open to the road or to a side opposite to the road, and wherein said top wall is a top plate of the box-shaped protrusion into which the rod is inserted through said hole with its bottom threaded portion being threadedly engaged with a lower nut of which said threaded member is comprised; wherein the board has cuts in a bottom portion at the predetermined intervals, the cuts being tightly fitted in the respective box-shaped protrusions, and wherein the board is mounted on the footing by the box-shaped protrusions and a sealing material.

3. The sound insulating wall as claimed in claim 1, wherein the horizontal fixing plate is slightly wider than a top surface width of the footing.

4. The sound insulating wall as claimed in claim 1, further comprising transparent plates detachably fitted in windows that are formed in the board.

5. The sound insulating wall as claimed in claim 1, wherein the board is made of PC-steel-reinforced precast and prestressed concrete.

6. A sound insulating wall comprising:

fixing members mounted, at predetermined intervals, on a top portion of a footing that is built along a road;

a concrete-type board mounted on the footing by the fixing member, the board having through-holes vertically formed therein at the predetermined intervals;

steel rods, each having top and bottom threaded portions and being inserted into the respective through-holes of the board, the bottom threaded portions being threadedly engaged with the respective fixing members; and upper nuts being threadedly engaged with the top threaded portions of the respective rods, to thereby fix the board onto the footing;

wherein each of the fixing members comprises a horizontal plate and a lower nut which is fixed to a bottom surface of the horizontal plate, accommodated in a groove formed in a top surface of the footing, and threadedly engaged with the bottom threaded portion of the rod, and wherein the board is mounted on the footing through the horizontal plates and a sealing material.

* * * * *